US005137091A

United States Patent [19]

Duster

[11] Patent Number: 5,137,091

[45] Date of Patent: Aug. 11, 1992

[54] PROCESS OF PRODUCING MOLDED BODY FROM GREEN MOLDING SAND

[75] Inventor: Heinz Duster, Monheim, Fed. Rep. of Germany

[73] Assignee: Georg Fischer AG, Schaffhausen, Switzerland

[21] Appl. No.: 539,809

[22] Filed: Jun. 18, 1990

[51] Int. Cl.[5] ..... B22C 15/28

[52] U.S. Cl. ..... 164/7.1; 164/37; 164/38; 164/160.1; 164/186; 164/195

[58] Field of Search ..... 164/7.1, 37, 38, 160.1, 164/207, 228, 213, 195, 186

[56] References Cited

U.S. PATENT DOCUMENTS

| | | | |
|---|---|---|---|
| 3,293,703 | 12/1966 | Taccone | 164/160.1 |
| 4,063,586 | 12/1977 | Keller | 164/37 X |
| 4,415,015 | 11/1983 | Zadera | 164/37 |
| 4,620,584 | 11/1986 | Witt | 164/160.1 |
| 4,781,236 | 11/1988 | Uzaki et al. | 164/195 X |
| 4,791,974 | 12/1988 | Larsen | 164/7.1 |

FOREIGN PATENT DOCUMENTS

| | | | |
|---|---|---|---|
| 3238712 | 4/1984 | Fed. Rep. of Germany | 164/207 |
| 910317 | 3/1982 | U.S.S.R. | 164/38 |
| 1161227 | 6/1985 | U.S.S.R. | 164/38 |

*Primary Examiner*—J. Reed Batten, Jr.
*Attorney, Agent, or Firm*—Bachman & LaPointe

[57] ABSTRACT

Green sand is packed as molding sand into a compression mold and the green sand is precompacted in the mold using a hydraulic press and thereafter is finally compacted after the precompaction wherein prior to precompaction recesses formed in the molding tools are subjected to a vacuum for drawing the molding sand into the recesses. In this way, even complicated mold cores can be produced satisfactorily and efficiently from green sand.

3 Claims, 1 Drawing Sheet

PROCESS OF PRODUCING MOLDED BODY FROM GREEN MOLDING SAND

BACKGROUND OF THE INVENTION

The present invention is drawn to a method and apparatus for producing molded bodies of molding sand for foundry use employing molding tools having complicated molding recesses in the tool surface.

Various processes are known for producing mold cores of molding sand for foundry use, which employ molding sand and molding tools. For example, it is known in the prior art to employ mechanically operated presses when using conventional molding sands and simple molding tools. On the other hand, complicated molding tools having molding recesses or cavities in the tool surfaces require on the one hand the use of quartz sand with an admixture of a resin adhesive or similar binders and, on the other hand, the use of vibrating or blasting machines. However, quartz sand is expensive and the use of vibrating or blasting machines is complicated from the mechanical engineering aspect. The present invention aims to provide a suitable remedy to overcome the foregoing disadvantages.

Accordingly, it is the principal object of the present invention to provide a process and apparatus by means of which mold cores having a complicated and delicate surface design and shape can be produced satisfactorily and simply in a mechanical way employing green sand.

SUMMARY OF THE INVENTION

The foregoing object is achieved by the present invention by providing a molding process and apparatus which is characterized in that green sand is packed as molding sand into a compression mold and the green sand is precompacted in the compression mold using a hydraulic press and thereafter is finally compacted after the precompaction.

BRIEF DESCRIPTION OF THE DRAWINGS

The present invention is described in more detail hereinafter with the aid of an embodiment illustrated in the drawings, wherein.

DETAILED DESCRIPTION

Figure 2:
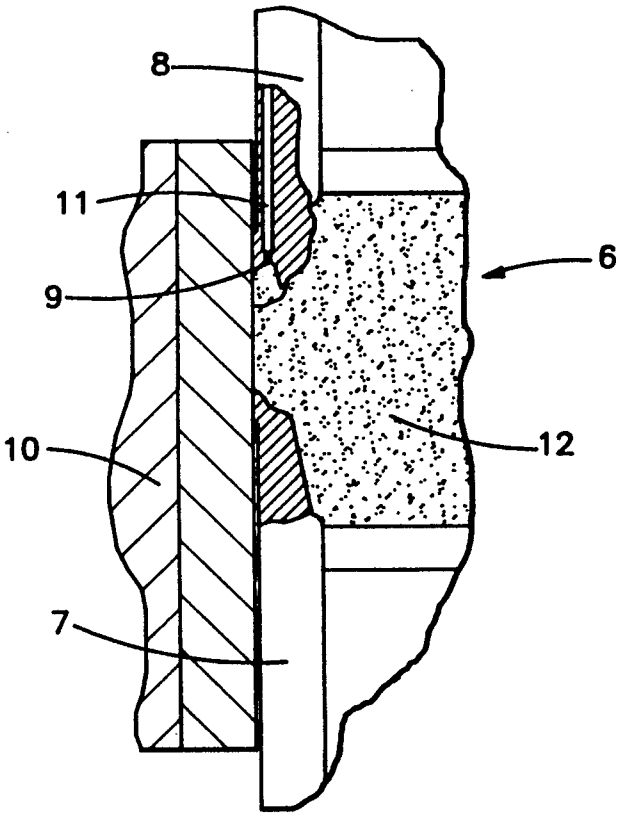
FIG. 2 is an enlarged section of the compression mold according to FIG. 1 in the edge region of the molding tools.
Figure 1:
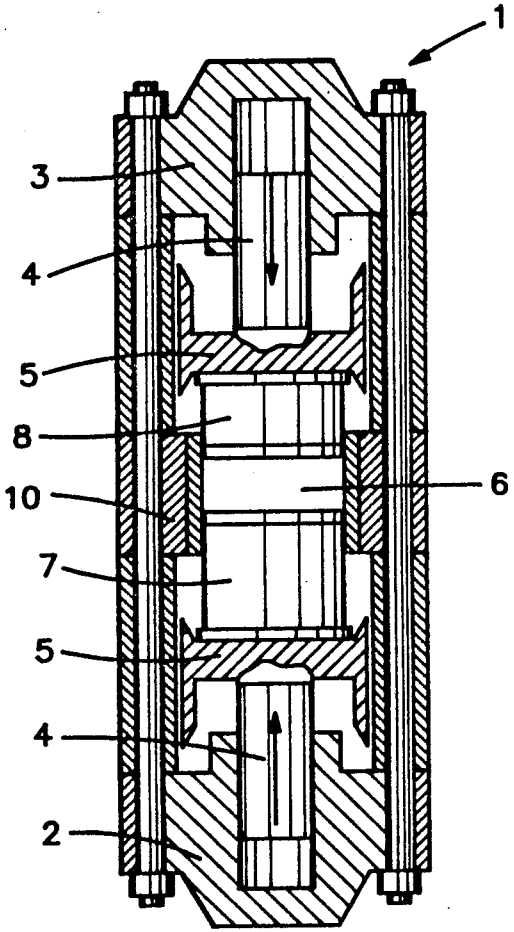
FIG. 1 is a diagrammatic vertical section of a hydraulic press for carrying out the claimed process.

In accordance with the present invention it has been surprisingly found that green sand, an extremely inexpensive molding sand, and a hydraulic press can be used to produce mold cores of complicated and delicate surface designs if the green sand is first of all precompacted in a compression mold and thereafter finally compacted. It has been found that in the course of the precompaction even complicated molding recesses in the surface of the molding tools can be satisfactorily filled. In such a case the green sand is sufficiently compacted even in the complicated molding recesses. The hydraulic press enables the molding tools to be accurately controlled for the precompaction on the one hand and for the subsequent final compaction on the other hand. The result is that mold cores of high basic strength and satisfactory reproduction of the complicated surface are formed. Accordingly, mold cores for even complicated castings can be produced simply and efficiently from inexpensive green sand according to the process of the invention. These features are the basic advantages achieved by the present invention.

Further features according to the present invention are described hereinafter. In accordance with the preferred process of the present invention, the green sand is sucked into the molding recesses of the tool or tools before the precompaction step. In this way, the packing of the complicated molding recesses with green sand is optimized. The process of the present invention also comprises displacing the lower molding tool with embossed tool surfaces or with the molding recesses upwardly against the upper molding tool with the molding recesses or with embossed tool surfaces in order to effect the precompaction of the green sand and, thereafter, both molding tools are simultaneously moved towards one another to effect the final compaction. Of course, in principle, the lower molding tool too may have the complicated molding recesses, though it has surprisingly been found that it is easier to eject the green sand moldings from the mold if the upper molding tool has the complicated molding recesses, and if also the aspiration of the green sand as well as the precompaction take place as it were from the bottom up. The molding body can then be ejected by means of compressed air or with the assistance of compressed air in the region of the complicated molding recesses on the tools. Also, the ejection of the green sand moldings from the mold is thereby facilitated and thus damage to the complicated and delicate surface shapes and contours is avoided.

The present invention is also drawn to a press with molding tools having molding recesses which are insertable into a compression mold and having a molding table. The press is particularly suitable for implementing the process of the present invention and is characterized by a hydraulic press in which the molding tool with the molding recesses has channel bores that lead to the molding recesses and can also be subjected alternately to vacuum or high pressure. These channel bores thus function on the one hand as suction lines for aspirating the green sand into the complicated molding recesses and, on the other hand, as compressed air lines during ejection of the mold body with the assistance of compressed air in the region of the complicated molding recesses. In this connection, according to the teaching of the invention, the upper molding tool has the complicated molding recesses and the channel bores terminate in the said recesses. However, it is within the scope of the invention that the lower molding tool may also have the molding recesses and channel bores. The molding recesses are preferably arranged in the edge region of the relevant molding tool since the aspiration and precompaction of the green sand in the complicated molding recesses can be performed in a particularly controlled manner just in the edge region of the tool and, finally, a uniform and bilateral final compaction ensures an exact dimensional accuracy of the moldings and mold cores. In this way, a sufficient and uniform porosity is achieved over the cross-section of the mold cores, so that, during the course of the casting process, a satisfactory degassing and, ultimately, a smooth surface of the casting is ensured.

The figures show a hydraulic press 1 with lower traverse 2, upper traverse 3, cylinder piston arrangements 4 and guide members 5 for molding tools 7, 8 with molding recesses 9 that can move in a compression mold 6. The compression mold 6 is situated in the region of a molding table 10. The molding tool 8 with the complicated molding recesses 9 in the tool surface has channel bores 11 that lead to the molding recesses 9 which can be subjected selectively to vacuum pressure or high pressure. In the preferred embodiment, the upper molding tool 8 has the complicated molding recesses 9 and the channel bores 11 which terminate in the molding recesses. The molding recesses 9 are arranged in the edge region of the molding tool 8. Green sand 12 is used as molding sand when employing such a hydraulic press 1. The green sand is firstly precompacted in the compression mold 6 and is finally compacted after the precompaction. This is sufficient to ensure a satisfactory filling of the complicated molding recesses 9 with green sand 12. This effect is optimized by virtue of the fact that the green sand 12 is aspirated into the complicated molding recesses 9 through the channel bores 11 before the precompaction, and the said bores are subjected to compressed air after the compression process to thereby assist the ejection of the molding and relevant mold core from the mold.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A process for producing a molded body of molding sand in a compression mold defined by first and second opposed molding tools at least one of which has complicated molding recesses in the surface thereof comprising the steps of:

(a) filling the compression mold with green molding sand;

(b) drawing the green molding sand into said molding recesses prior to precompaction of the green molding sand by means of a vacuum;

(c) precompacting said green molding sand by moving said first opposed molding tool toward said second opposed molding tool;

(d) finally compacting said green sand after precompaction by moving said first and second opposed molding tools toward each other to produce said molded body; and (e) ejecting the molded body from the compression mold by means of compressed air.

2. A process according to claim 1 wherein said green sand is precompacted using a hydraulic press.

3. A process according to claim 1 wherein said drawing and ejecting steps are carried out through said first molding tool.

* * * * *